United States Patent [19]

Hartung et al.

[11] Patent Number: 4,716,828

[45] Date of Patent: Jan. 5, 1988

[54] RESILIENT SHEET GRIPPER FOR A SHEET-FED ROTARY PRINTING PRESS

[75] Inventors: Winfried Hartung, Offenbach am Main; Valentin Gensheimer, Muhlheim/Main, both of Fed. Rep. of Germany

[73] Assignee: M.A.N.-Roland Druckmaschinen Aktiengesellschaft, Fed. Rep. of Germany

[21] Appl. No.: 893,487

[22] Filed: Aug. 5, 1986

[30] Foreign Application Priority Data

Aug. 19, 1985 [DE] Fed. Rep. of Germany ..... 3529598

[51] Int. Cl.[4] ..... B41F 1/30

[52] U.S. Cl. ..... 101/415.1; 101/409; 271/277

[58] Field of Search ..... 101/415.1, 409; 271/277

[56] References Cited

FOREIGN PATENT DOCUMENTS

| | | | |
|---|---|---|---|
| 559297 | 6/1958 | Canada | 101/415.1 |
| 1005981 | 4/1957 | Fed. Rep. of Germany | 271/277 |
| 2027912 | 6/1979 | Fed. Rep. of Germany | 271/277 |

*Primary Examiner*—Charles A. Pearson
*Assistant Examiner*—Huong Q. Pham
*Attorney, Agent, or Firm*—Leydig, Voit & Mayer

[57] ABSTRACT

A resilient sheet gripper for a sheet-fed rotary printing press having a gripper shaft and a gripper finger disposed in a recess of a cylinder of the printing press and including an asymmetrical four-pivot mechanism having the gripper finger as one of its links for governing the motion of the gripper finger and ensuring perpendicular closing of the tip thereof with respect to a sheet engaged on a gripper support at the edge of the recess.

9 Claims, 8 Drawing Figures

RESILIENT SHEET GRIPPER FOR A SHEET-FED ROTARY PRINTING PRESS

FIELD OF THE INVENTION

The present invention relates generally to a sheet gripper for a sheet-fed rotary printing press and more particularly concerns such a gripper having a resilient gripper finger.

BACKGROUND OF THE INVENTION

Resilient sheet grippers are widely used in printing presses to non-positively grip a sheet of paper and hold it up against a cylinder. If the paper is pulled out of the gripper even slightly, problems arise with mackling and registration errors occur. Therefore, the gripper typically is required to have a very considerable retaining force, which usually means that the gripper springs must have a very high spring constant. Also, since any play present at the gripper tip would result in registration errors and mackling, it is desirable to minimize the bearing clearances of the gripper elements. The reduced bearing clearance, however, leads to increased friction in the gripper bearings so that some of the spring force operative for gripping is consumed in the bearing itself. The need further arises for the gripper shaft bearings to be very stable in order to reduce deformation associated with the abrupt closure of the grippers. A disadvantage of this is that very high mass forces are produced.

In short, the known gripper systems require very considerable forces for their actuation and only some of such forces can be used for sheet retention. Furthermore, these substantial and abrupt forces may cause unwanted oscillations of the press.

A gripper system of this general kind is shown in DE-PS No. 1 174 804 wherein a one-piece gripper lever is mounted on a gripper shaft with adjustable biasing of the lever provided by a compression spring. One end of the gripper lever is connected to a spring end on a clamping element and the other end bears on the gripper support with the gripper closed and on a bearing stop with the gripper open. The compression spring is so arranged that the horizontal components of the spring force, support force and bearing force act in the same direction. The disadvantage of this type of gripper is that at very high press speeds and at elevated biasings, the gripper reacts sluggishly because of friction between the lever and the gripper shaft and because of the relatively larger masses and inertia radii. Unwanted oscillations introduced into the press also cause the gripper to lose its position when the gripper tip is being centered.

Another known gripper system is disclosed in DE-OS No. 1 908 181 wherein the spindle of the gripper finger pivot is pivotally disposed parallel to the gripper shaft, the spindle of the gripper finger pivot being disposed substantially on the prolongation of a straight line connecting the support surface for the gripper tip to the gripper shaft axis. As is apparent from the geometry shown therein in FIG. 1, the force which the gripper tip applies to the gripper support also has a component in the direction of sheet movement. The sheet may therefore move for this reason and because of possible twisting of the gripper shaft at high biasings, even though there may be some improvement as compared with conventional grippers in which there is an arcuate motion around the gripper shaft axis.

The gripper disclosed in DD-PS No. 67 992 is mounted by means of a clamping member on a pivotable gripper shaft having a stationary axis. A gripper tongue makes a circular movement around such axis in a first movement phase and makes a movement substantially perpendicular to the gripper support in a second movement phase. This gripper, however, uses a non-positive parallel spring strip arrangement and a gripper tongue which cannot withstand substantial closing forces without buckling. The gripper is therefore completely unsuitable for use with very high closing forces.

Gripper systems of the type disclosed in DE-PS No. 2 030 040 utilize a perpendicularly closing gripper with a controlled gripper shaft. A disadvantage of this known system is that the non-positive actuation of the gripper shaft relative to the fulcrum of an actuating lever is by means of a guide on a control cam. The additional components associated with the control cam lead to increased mass forces of the system. The components also oscillate with substantial radii of inertia, leading to a reduction in press performance. Also, if dirt accumulation of the cam is fairly heavy, accurate guidance of the gripper movement phases is impossible.

The gripper system shown in DE-OS No. 3 130 689 uses a soft gripper support along with a gripper finger which has a flat gripper flight path and which closes perpendicularly in the final movement phase. There is a resilient abutment screw disposed in the gripper finger and operative against the sheet gripper stop. A further adjusting screw is needed to adjust the resiliently interconnected holders by which the gripper finger is associated with the gripper shaft. A disadvantage of this type of gripper is that the gripper finger must be associated with a soft gripper support and complicated adjustment must be made by means of two adjusting screws to ensure accurate operation. Furthermore, the gripping action becomes uncertain at high press speeds.

OBJECTS AND SUMMARY OF THE INVENTION

It is a primary object of the present invention to provide a gripper of the kind hereinbefore set out wherein the closing gripper finger has a second movement phase characterized by a positive movement substantially perpendicular to the gripper support.

This is accomplished, according to the present invention, by a sheet gripper wherein the gripper finger serves as one link of an asymmetrical four-pivot mechanism which governs the motion of the gripper finger and ensures the perpendicular closing of the tip thereof.

The primary advantage of the present sheet gripper is its ability to operate at high press speeds and high biasing forces without either disturbing forces or oscillations having any adverse effect in the direction of sheet movement. In addition, the present gripper is not subject to problems arising from dirt accumulation, the use of a soft gripper support, or the use of a thin gripper tip which may be prone to buckling. Moreover, sheet retention is improved by the more positive nature of the perpendicular closing step so that the gripper finger remains in its statically determined position and reacts less sluggishly. Except for some friction loss, the entire torque applied to the gripper shaft is used to create the gripper retaining force. The required actuating force is therefore reduced. Also, the travel of the gripper tip can readily be varied by an appropriate choice of pivot geometry or eccentric bearings on the gripper shaft. This latter advantage applies especially when the top rectilinear guide is embodied as a link and the mechanism is indirectly driven by the gripper shaft as is shown hereinafter. Since less space is required in the available fitting space, it is possible to finely tune the gripper closing spring so that the characteristics of the closing operation can be better adapted to specific printing requirements.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
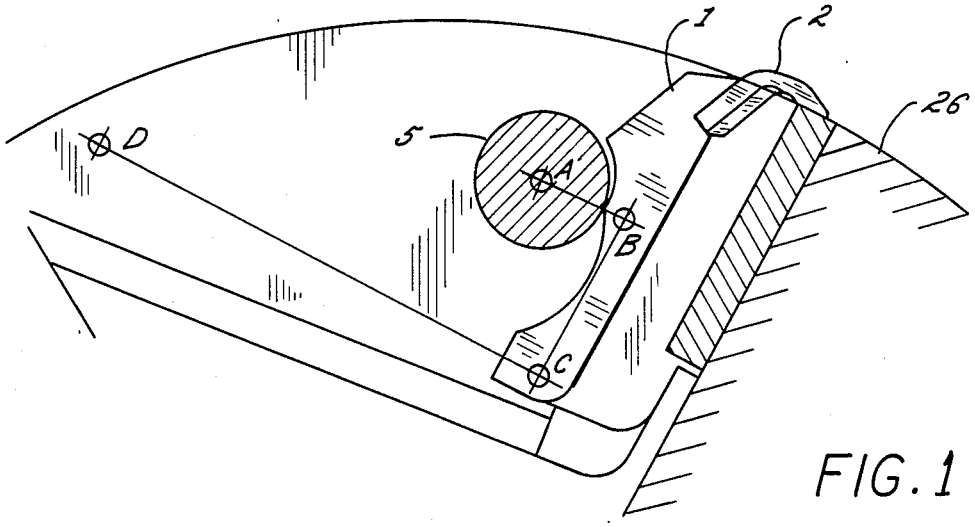
FIG. 1 is a diagrammatic illustration of a sheet gripper in a case in which the gripper shaft is mounted concentrically and the gripper is in the closed state.
Figure 2:
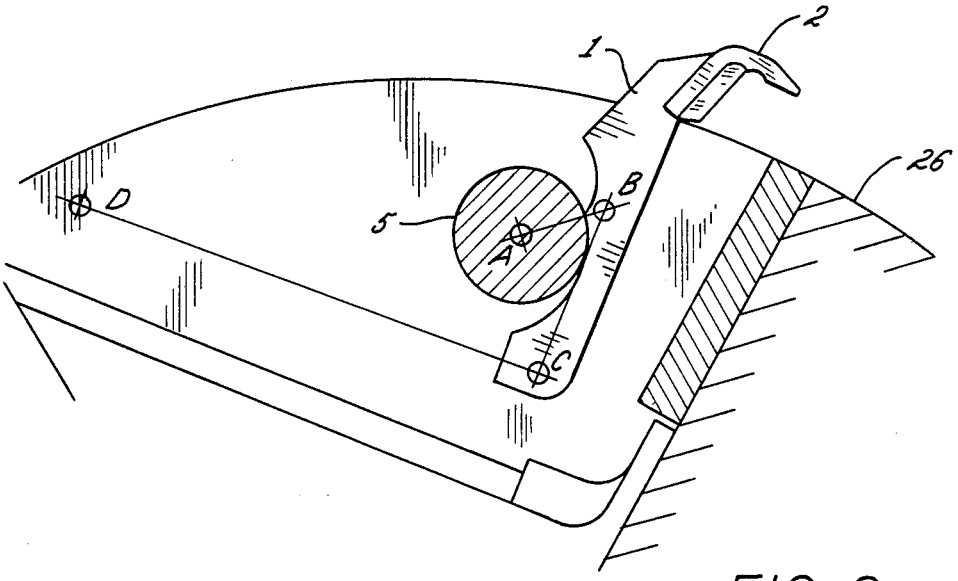
FIG. 2 is a view similar to FIG. 1 but with the gripper open.

Turning now to the drawings, FIG. 1 is a diagrammatic view of a gripper control for a resilient sheet gripper disposed on a concentrically mounted gripper shaft 5, the control being provided by an asymmetrical four-pivot mechanism A, B, C, D. A gripper finger 1 constitutes one link of the mechanism and is arranged so that the gripper is closed perpendicularly to the sheet surface by positive actuation. Control of the gripper movement, as can be seen in FIG. 2, is by way of a long lever arm C, D and by way of a short lever arm A, B which first raises the gripper perpendicularly, but then, as it rotates, it pivots a gripper tip 2 of the finger 1 off the sheet. It is understood that the function of the long lever arm C, D could equally be served by a rectilinear guide at C.

Figure 3:
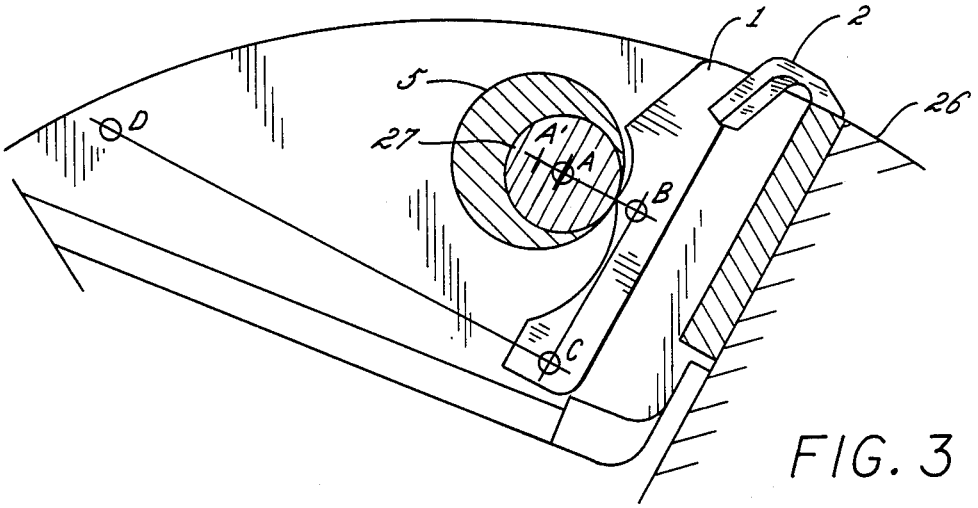
FIG. 3 is a diagrammatic illustration of a sheet gripper in which the gripper shaft is mounted eccentrically and the gripper is in the closed state.
Figure 4:
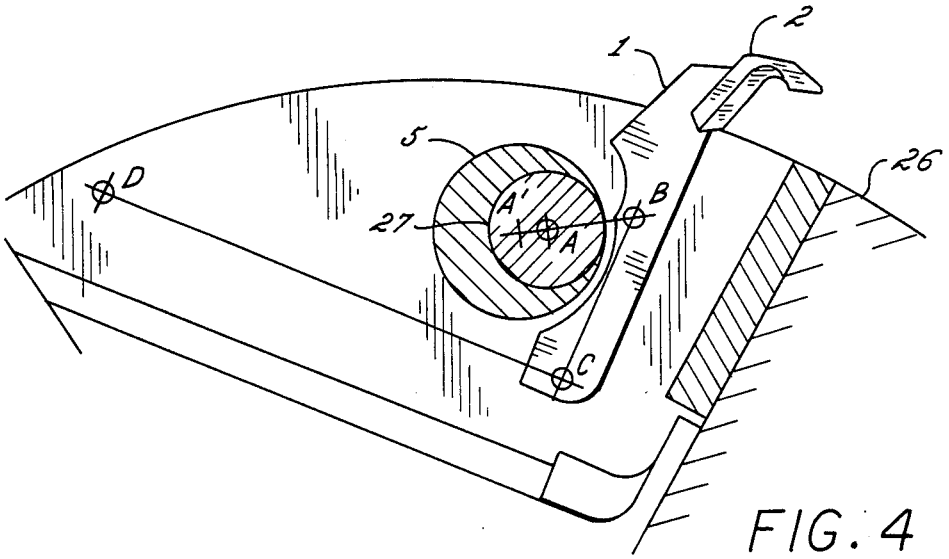
FIG. 4 is a view similar to FIG. 3 but with the gripper open.

FIGS. 3 and 4 show a gripper shaft 5 mounted by means of an eccentric pin 27, A being the center of the bearing and A′ being the center of the gripper shaft 5. Such an arrangement is one way to allow the length of lever arm A, B to be shortened without the need for a thinner gripper shaft 5, further allowing the tip 2 to be more quickly pivoted away from the sheet, enhancing performance at relatively high press speeds.

Figure 5:
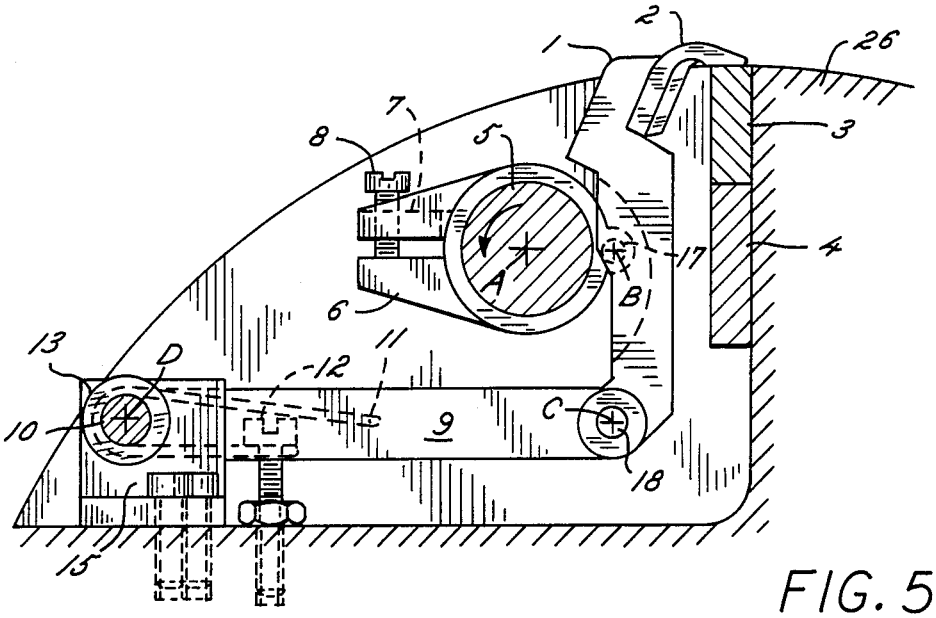
FIG. 5 is a side view of a resilient gripper according to the present invention with the gripper shaft mounted concentrically and with the gripper in the closed state.
Figure 6:
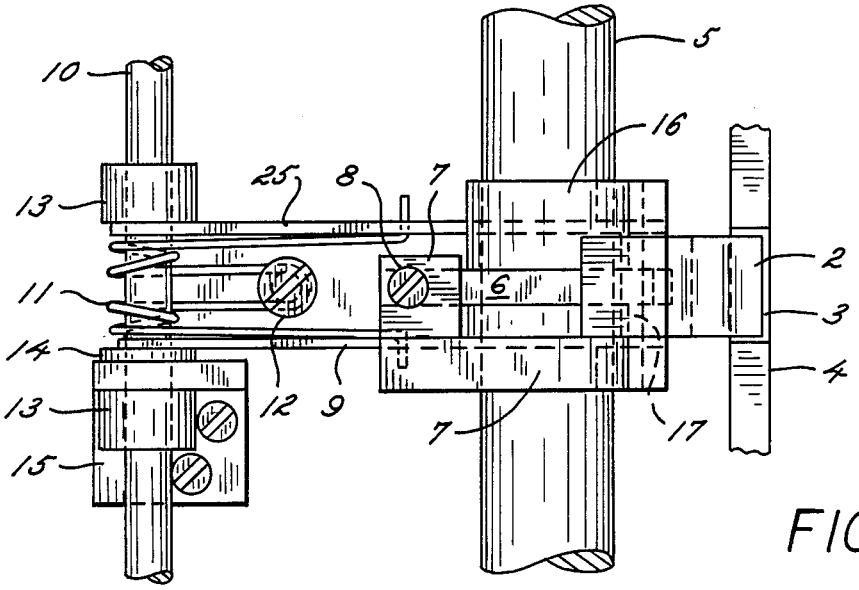
FIG. 6 is a plan view of the gripper of FIG. 5.

According to the invention, FIGS. 5 and 6 show a resilient sheet gripper for a sheet-fed rotary printing press embodying the principle diagrammatically shown in FIGS. 1 and 2, wherein the gripper is controlled by an asymmetrical four-pivot mechanism. A gripper support 3 is secured to an auxiliary rail or rod 4 adjacent the edge of a gripper assembly recess 28 in the cylinder 26. The gripper finger 1 has a tip 2, which co-operates with the support 3, and is secured to the gripper shaft 5, the shaft 5 having a stationary axis and being rotatably mounted in the recess 28. The finger 1 is moved by means of an asymmetical four-pivot mechanism A, B, C, D biased resiliently by a gripper closing spring 11, such movement being substantially perpendicular to the support 3 and radially with respect to the cylinder 26 as the gripper is closed and as it is pivoted off the sheet such as is diagrammatically illustrated in FIGS. 1 and 2, respectively.

Adjusting rings 13 and a spacer disc 14 fix the axial position of long, spaced-apart pivot links 9, 25 which, in order to guide the finger 1, are disposed rotatably on a pin 18 on the radially inner end of the finger 1 and on a support shaft 10 secured to an assembly member 15 disposed in the recess 28. By way of another pin 17 the finger 1 is pivotally connected to an annular entraining member 6 disposed for rotation on the shaft 5 and located axially by means of an adjusting ring 16. An annular acutating element 7 disposed fixedly on the shaft 5 acts by way of an adjusting screw 8 to actuate the member 6. The screw 8 can be adjusted to enable all the grippers mounted on one shaft 5 to start closing or opening simultaneously. The closing force of the gripper can be adjusted by means of a screw 12 associated with the spring 11 and suitably anchored in the recess 28.

Figure 7:
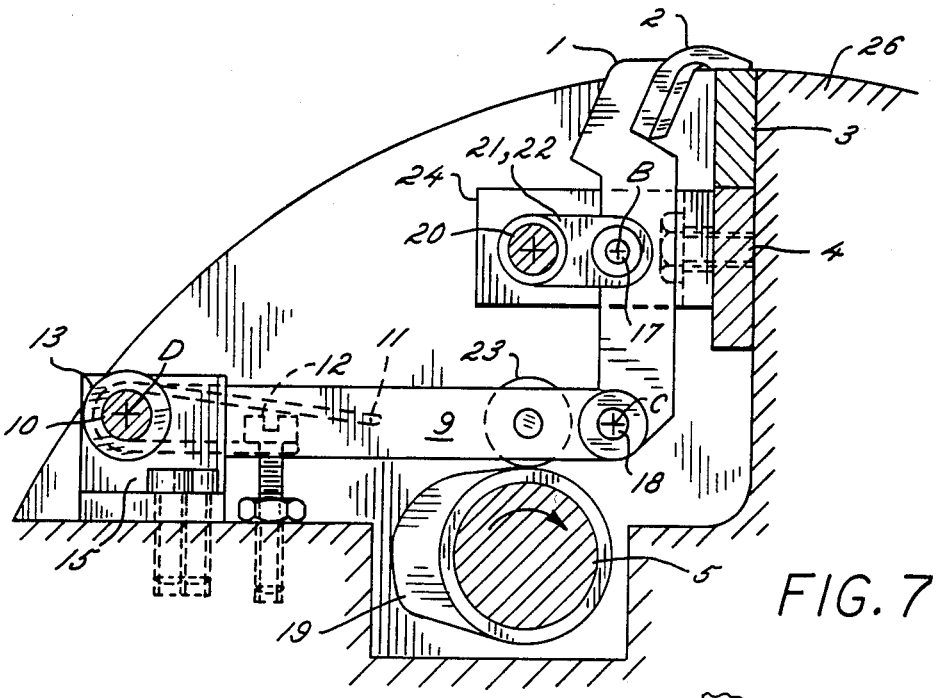
FIG. 7 is a side view of an alternative resilient gripper with the gripper shaft mounted concentrically providing indirect drive to the gripper mechanism and with the gripper in the closed state.
Figure 8:
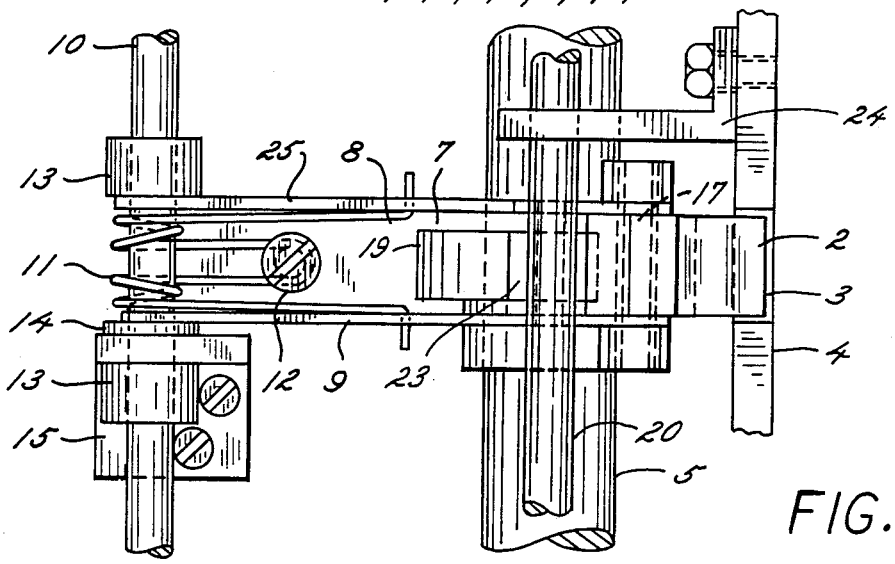
FIG. 8 is a plan view of the gripper of FIG. 7.

Pursuant to another embodiment of the invention, FIGS. 7 and 8 show a sheet gripper according to the present invention wherein the gripper tip can be more quickly pivoted away from the sheet without the need for the gripper shaft 5 to be mounted eccentrically as noted above and shown in FIGS. 3 and 4. To this end, the finger 1 is mounted by way of a pivot 17 to a short lever arm A, B formed as spaced-apart pivot links 21, 22 for pivoting around a top support shaft 20 whose axis is A, while the long pivot links 9, 25 are indirectly driven by a roller 23 and a cam 19 on the gripper shaft 5 which is mounted below the axis of the support shaft 20. In this way, the short lever arm A, B can have a pivoting radius smaller than the radius of the shaft 5 thereby quickening the pivoting action of the tip 2. The top shaft 20 is preferably mounted in the recess 28 of the cylinder 26 by way of an assembly block 24.

We claim as our invention:

1. A resilient sheet gripper for use in the recess of a rotatable cylinder of a sheet-fed rotary printing press comprising, in combination, a gripper support surface on said rotatable cylinder adjacent the edge of said recess, a first shaft and a second shaft disposed in said recess, a gripper finger disposed in said recess substantially radially with respect to said cylinder and having a gripper tip engageable with said gripper support for holding the edge of a sheet, an asymmetical four pivot mechanism including a short link, a long link and said gripper finger as an intermediate link, said short link pivotally connected at one end to a radially outer portion of said gripper finger and at the other end to said first shaft for movement around said first shaft said long link pivotally connected at one end to a radially inner end of said gripper finger and at the other end to said second shaft for movement around said second shaft spring means for biasing said gripper finger radially inwardly toward its closed position with said gripper tip engaging said gripper support, means interconnecting said first shaft and said four-pivot mechanism for swinging said gripper finger radially outwardly on the end of said long link against the bias of said spring means to raise said gripper tip substantially radially off of said gripper support, and said short pivot link causing said gripper finger to rotate on the end of said long link so as to swing said gripper tip substantially circumferentially away from said gripper support to release the sheet edge.

2. A sheet gripper according to claim 5, wherein said first shaft is a gripper shaft and said asymmetrical four-pivot mechanism further comprises an actuating element rigidly secured to said gripper shaft, an annular entraining member rotatably mounted on said gripper shaft, said annular entraining member being pivotally connected to said gripper finger as said short link and abutted against said actuating element.

3. A sheet gripper according to claim 2, wherein said gripper shaft is formed with an eccentric portion of reduced diameter about which said entraining member is rotatably mounted.

4. A sheet gripper according to claim 2 wherein said annular entraining member carries an adjusting screw for abutting said actuating element.

5. A sheet gripper according to claim 1 wherein said spring means is connected at one end to said long pivot link and at the other end to an anchoring means disposed in said recess.

6. A sheet gripper according to claim 5 wherein said anchoring means includes means for adjusting the bias of said spring means.

7. A sheet gripper according to claim 1, including a gripper shaft, a roller secured to said long pivot link, and a cam on said gripper shaft disposed to engage said roller, said gripper shaft being disposed vertically below said first shaft.

8. A sheet gripper according to claim 7 wherein said spring means is connected at one end to said long pivot link and at the other end to an anchoring means disposed in said recess.

9. A sheet gripper according to claim 8 wherein said anchoring means includes means for adjusting the bias of said spring means.

* * * * *